US011028682B1

(12) United States Patent
Zhang

(10) Patent No.: US 11,028,682 B1
(45) Date of Patent: Jun. 8, 2021

(54) ECCENTRIC PIPE-IN-PIPE DOWNHOLE GAS SEPARATOR

(71) Applicant: The University of Tulsa, Tulsa, OK (US)

(72) Inventor: Hong-Quan Zhang, Tulsa, OK (US)

(73) Assignee: The University of Tulsa, Tulsa, OK (US)

( * ) Notice: Subject to any disclaimer, the term of this patent is extended or adjusted under 35 U.S.C. 154(b) by 395 days.

(21) Appl. No.: 15/342,188

(22) Filed: Nov. 3, 2016

Related U.S. Application Data

(60) Provisional application No. 62/250,335, filed on Nov. 3, 2015.

(51) Int. Cl.

| | |
|---|---|
| ***E21B 43/38*** | (2006.01) |
| ***E21B 17/18*** | (2006.01) |
| ***E21B 43/12*** | (2006.01) |
| ***E21B 34/08*** | (2006.01) |
| *E21B 33/12* | (2006.01) |

(52) U.S. Cl.
CPC ..... *E21B 43/38* (2013.01); *E21B 17/18* (2013.01); *E21B 34/08* (2013.01); *E21B 43/128* (2013.01); *E21B 33/12* (2013.01); *E21B 2200/04* (2020.05)

(58) Field of Classification Search
CPC ..... E21B 43/38; E21B 17/18; E21B 34/08; E21B 43/128; E21B 33/12; E21B 2034/002
See application file for complete search history.

(56) References Cited

U.S. PATENT DOCUMENTS

| | | | | |
|---|---|---|---|---|
| 1,625,674 A * | 4/1927 | Newburn | E21B 49/087 166/106 |
| 2,010,947 A * | 8/1935 | Dunlap | E21B 43/38 166/105.1 |
| 2,698,586 A * | 1/1955 | Bullock | E21B 37/00 417/446 |
| 2,748,719 A * | 6/1956 | Wells | E21B 43/38 166/105.5 |
| 4,655,247 A * | 4/1987 | Westra | E21B 21/10 137/519.5 |
| 5,653,286 A * | 8/1997 | McCoy | E21B 43/38 166/105.5 |
| 6,029,685 A | 2/2000 | Carruth | |
| 6,830,441 B1 * | 12/2004 | Williams | E21B 34/06 166/105 |

(Continued)

OTHER PUBLICATIONS

Jyothi Swaroop Samayamantula, An Innovative Design for Downhole Gas Separation, taken from http://www.don-nan.net/papers/gas_separation.pdf on Oct. 16, 2015.

*Primary Examiner* — Waseem Moorad
*Assistant Examiner* — Neel Girish Patel
(74) *Attorney, Agent, or Firm* — Head, Johnson, Kachigian & Wilkinson, PC

(57) ABSTRACT

An eccentric pipe-in-pipe downhole gas separator apparatus for separation of gas from liquid in a downhole well. The separator apparatus includes an outer tube having an inner diameter and an inner tube having an outer diameter smaller than the inner diameter of the outer tube. The inner tube is eccentric to the outer tube wherein a conduit having a crescent shaped cross-section is formed between the inner diameter of the outer tube and the outer diameter of the inner tube.

13 Claims, 6 Drawing Sheets

(56) References Cited

U.S. PATENT DOCUMENTS

| | | | | |
|---|---|---|---|---|
| 9,638,014 | B2 * | 5/2017 | Reid | F04D 13/10 |
| 2007/0119588 | A1 * | 5/2007 | Gonzalez | E21B 43/38<br>166/105.5 |
| 2009/0065202 | A1 | 3/2009 | Brown et al. | |
| 2010/0258306 | A1 * | 10/2010 | Camilleri | E21B 43/128<br>166/265 |
| 2011/0127043 | A1 * | 6/2011 | Hahn | E21B 43/123<br>166/373 |
| 2011/0278015 | A1 * | 11/2011 | Mazzanti | E21B 17/18<br>166/372 |
| 2013/0032341 | A1 * | 2/2013 | Raglin | E21B 43/127<br>166/265 |

* cited by examiner

ECCENTRIC PIPE-IN-PIPE DOWNHOLE GAS SEPARATOR

CROSS-REFERENCE TO RELATED APPLICATIONS

This application claims priority to and the benefit of U.S. Provisional Patent Application Ser. No. 62/250,335, filed Nov. 3, 2015, which is herein incorporated in its entirety by reference.

BACKGROUND OF THE INVENTION

1. Field of the Invention

The present invention relates to a method and apparatus for gas separation from liquid at downhole of an oil and gas well, using an eccentric pipe-in-pipe configuration. Compared to previous downhole gas separators, the present invention has a simpler structure, less resistance to flow, better velocity field for gas-liquid separation and larger liquid retention volume in order to absorb long slugs of liquid. For wells with sand or solids production, an embodiment with a bottom ball valve allows sand to sink into the bottom hole at shut-in and stop the short circuit flow at normal operation.

2. Related Art

Pumps, such as sucker rod pumps, progressive cavity pumps, and electrical submersible pumps (ESP) are used to maintain or increase oil production from subterranean reservoirs. For example, an electrical submersible pump includes a downhole pump and an electric motor to power the pump. The pumps force liquid from the reservoir through the well to the surface. Gases inevitably co-exist with oil during production. They are present in a downhole reservoir either as free gas or escape from liquid solution when pressure becomes lower. Gas involvement in the produced fluids can significantly reduce pump boosting pressure and efficiency. One rule of thumb is that an electrical submersible pump will not tolerate greater than 10 percent gas. When gas fraction reaches the critical value, gas lock condition will occur in an ESP and the pump does not provide any pressure increase. A solution to this gas degradation problem is to separate gas from liquid before the fluids enter the pump. The separated gas can be bypassed and produced through the casing-tubing annulus, or recombined with tubing flow through a gas lift valve at a higher location.

There are a number of existing downhole gas separator designs. In one example, Don-Nan Pump & Supply developed a concentric pipe-in-pipe gas separator which diverts the gas away from entering the pump intake. Through a ported coupling, gas-liquid flow is first directed into the annulus between the two tubes and exits from the top slots on the outer tube. Then, gas flows upward and liquid flows downward in the annulus between the separator and the well casing. At the bottom of the separator, liquid enters the inner tube of the separator through a port and flows toward the pump intake, free of gas. A drawback of this design is the restriction of the small ports to the flow.

For ESP applications, Brown, Wilson and James (U.S. Patent Publication No. 2009/0065202) proposed to use an ESP shroud for gas separation. A potential problem of this method is the entrainment of gas into the ESP shroud by liquid. Due to the small gap between the ESP shroud and the well casing, the local fluid velocity is relatively high. Gas may be dispersed in liquid as small bubbles. These small gas bubbles can be entrained by liquid into the ESP shroud at relatively high flow rate.

Centrifugal separators have also been proposed and used to condition the ESP intake flow. However, this kind of separator consumes additional power and increases pump failure probability. Most of the previous downhole gas separators cannot handle low frequency slugging due to insufficient volume of liquid and counter-current flow of gas and liquid.

It is known that cross-sectional area downhole is at a premium. It is desirable to develop a downhole gas separator that will maximize volume of through-put while accommodating various fractions of gas.

In some wells utilizing pumps, there are alternate periods where the pump is on and liquid is drawn to the surface by force of the pump and where the pump is off and sand and solids settle to the bottom of the well.

It is accordingly also desirable to develop a downhole gas separator that will accommodate sand or solids while efficiently separating gas from liquids.

SUMMARY OF THE INVENTION

The present invention uses an eccentric pipe-in-pipe configuration for downhole gas separation. In one preferred embodiment, a gas-liquid mixture flows from the well into an opening in an inner tube from the bottom. The mixture exits at the top from the inner tube across and through an outer tube wall. Then, separation occurs in the annulus between the outer tube and well casing with gas rising upward and liquid flowing downward.

At the bottom of the annulus, liquid enters a conduit having a crescent shaped cross-section formed between the two tubes through openings in the outer tube. Substantially free of gas, the liquid flows upward in the crescent shaped conduit.

A top of the gas separator apparatus is connected to a pump inlet, such as an ESP motor shroud. The single-phase liquid from the separator flows through an annulus between the ESP motor and the shroud. Efficient heat transfer between the ESP motor and the flowing liquid helps maintain the ESP motor temperature and prolong the pump run life.

The cross sectional area of the inner tube is slightly larger than the crescent shaped area between the inner and outer tubes considering the separated gas flow rate. A sufficiently large cross sectional annulus area between the separator apparatus and the well casing is important since it determines the largest bubble the liquid can entrain at a given flow rate. When sufficient separator apparatus length is used, the annulus volume between the separator apparatus and the well casing can eliminate the gas and liquid fluctuations due to hydrodynamic or low frequency long slugs (e.g. from a horizontal well). The liquid flow rate through the ESP needs to be controlled either by ESP rotation speed or a control valve based on the liquid level in the annulus monitored with liquid level sensors or pressure transmitters.

For wells with sand production, an alternate preferred embodiment of the gas separator of the present invention with a different flow path is used. The gas-liquid mixture from the bottom hole flows into a crescent shaped conduit between an outer tube and an inner tube of the apparatus from the bottom hole. It exits at the top from the crescent shaped conduit across and through openings on the outer tube wall. Then, separation occurs in the annulus between the separator and well casing, with gas rising upward and liquid flowing downward.

At or near the bottom of the annulus, liquid enters the inner tube through an opening across the outer tube. Substantially free of gas, liquid flows upward into the pump intake above.

A ball valve is installed at the bottom of the inner tube. During normal operation, the ball valve is closed by the suction force of the pump with the ball in an upper position. At shut-in condition, a ball in a ball valve cage will fall by gravity to its lower position and the valve will open. This allows sand particles to sink into the bottom hole through the opening. When production resumes, the ball valve will automatically close.

BRIEF DESCRIPTION OF THE DRAWINGS

FIG. 4 illustrates a cross-sectional view of an alternate preferred embodiment of the present invention, showing an eccentric pipe-in-pipe gas separator apparatus with a bottom ball valve to avoid sand or solids accumulation during shut-in;

DETAILED DESCRIPTION OF THE PREFERRED EMBODIMENTS

The embodiments discussed herein are merely illustrative of specific manners in which to make and use the invention and are not to be interpreted as limiting the scope of the instant invention.

Figure 1:
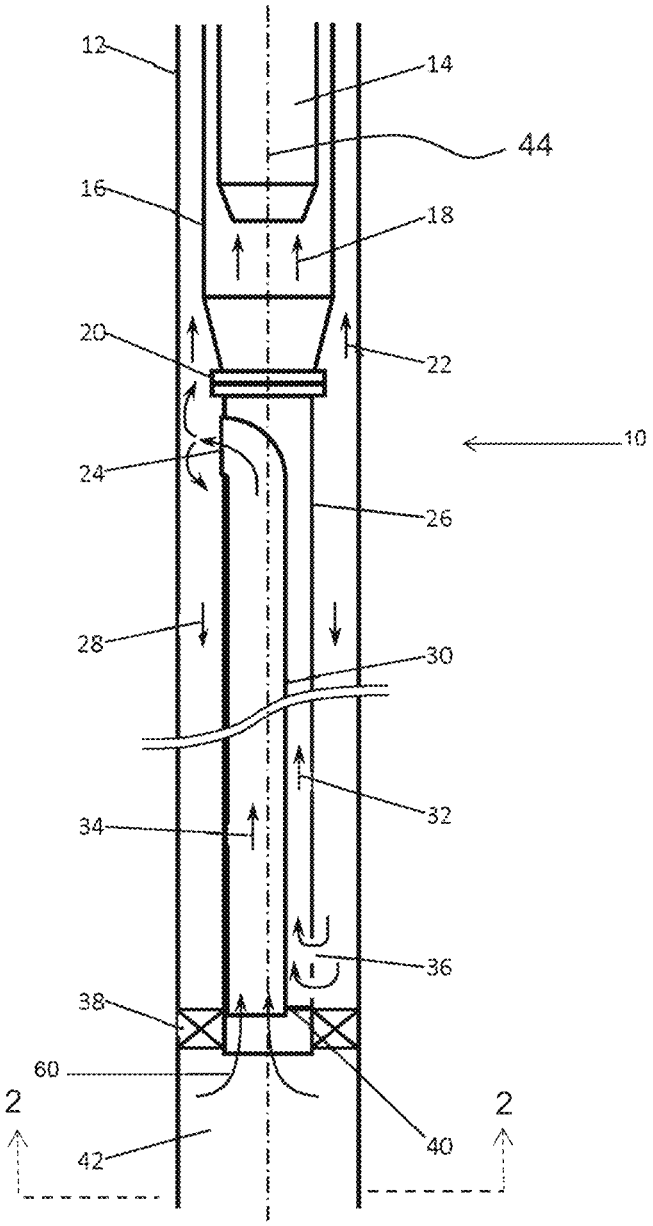
FIG. 1 illustrates a cross-sectional view of a preferred embodiment according to the present invention of an eccentric pipe-in-pipe gas separator apparatus located in a well downhole and connected to an electrical submersible pump (ESP)

FIG. 1 illustrates a simplified diagrammatic cross-sectional view of one preferred embodiment of a gas separator apparatus 10 in accordance with the present design. A cylindrical well casing 12 extends downhole from the surface (not shown) and terminates in an open end. The eccentric pipe-in-pipe gas separator apparatus 10 is installed vertically or installed with an inclination angle (not shown) close to the bottom hole 42 of a subterranean well. Dashed line 44 illustrates the center line of the well.

The gas separator apparatus 10 is suspended from equipment installed downhole. In the present case, the apparatus 10 is suspended from a shroud of an ESP pump or motor 14 by a connection 20. It will be appreciated that the separator apparatus 10 may be suspended from other equipment within the spirit and scope of the invention.

The apparatus 10 includes an inner cylindrical tube 30 having an outer diameter smaller than an inner diameter of an outer tube 26. The outer tube 26 is generally concentric with the axis 44 of the well and, in particular, with the casing of the well. The inner tube 30 is eccentric from the outer tube and is aligned or set against an inner wall of the outer tube 26.

A gas-liquid mixture from a reservoir flows to the bottom hole 42. Then, the gas-liquid mixture flows into the inner cylindrical tube 30 of the separator apparatus 10 as shown by arrows 60. The gas-liquid mixture then moves upward and exits through the inner tube and outer tube at the outlet 24. In the annulus formed by the well casing 12 and the outer tube 26, gas and liquid separate by gravity. Gas flows upward by floatation as shown by arrows 22 and liquid flows downward by gravity as shown by arrows 28. The cross sectional area of the annulus between the well casing 12 and separator apparatus outer tube 26 should be sufficiently large so that the liquid downward flow velocity will be low and only very small gas bubbles can be entrained by the liquid.

At the bottom of the gas separator apparatus 10, the annulus between the well casing 12 and the outer tube 26 is plugged by a packer 38. The packer 38 creates a fluid tight seal and centers the apparatus 10.

Figure 2:
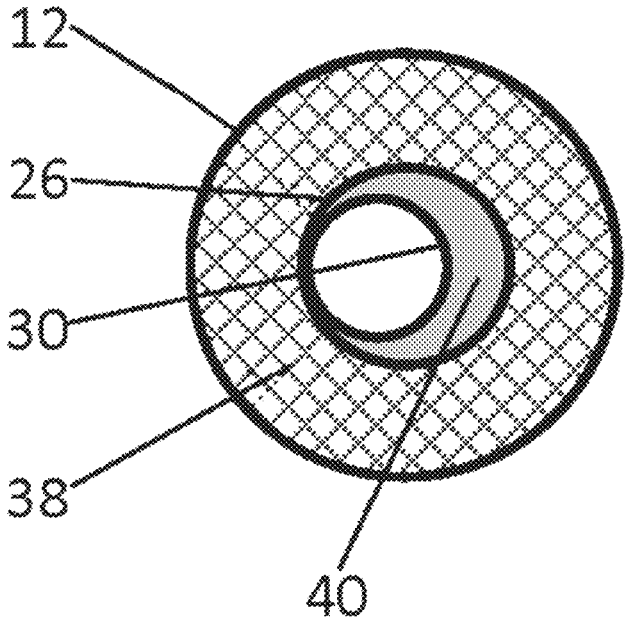
FIG. 2 illustrates a bottom view of the eccentric pipe-in-pipe gas separator apparatus shown in FIG. 1.

Liquid flows from the annulus into an area having a crescent shaped cross-section formed by the separator outer tube 26 and the separator inner tube 30 through a plurality of openings 36 in the separator outer tube 26 near the bottom of the apparatus 10. The crescent shaped cross-section may be best seen in FIG. 2 taken along section line 2-2 of FIG. 1. FIG. 2 illustrates a bottom view of the eccentric pipe-in-pipe gas separator apparatus 10 shown in FIG. 1. The crescent shaped conduit at the bottom is blocked by a sealing plate 40. Accordingly, liquid in the crescent shaped conduit cannot return to the bottom hole.

Liquid flows upward in the crescent shaped conduit and continues into a shroud 16 for an ESP motor 14 through a connection 20. The liquid continues upward toward the surface as shown by arrows 18. A further benefit of the present invention may be seen. Heat transfer between the ESP motor and the flowing liquid helps maintain the ESP motor temperature.

Figure 3:
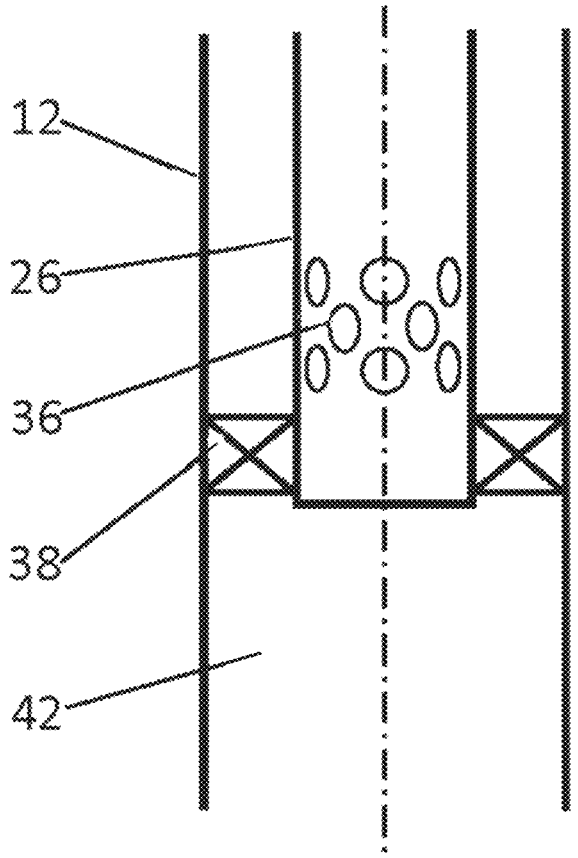
FIG. 3 illustrates a partial sectional, side view of the eccentric pipe-in-pipe gas separator apparatus shown in FIG. 1 showing bottom openings on an outer tube.

FIG. 3 illustrates a partial sectional, side view of the gas separator apparatus 10 showing the plurality of bottom openings 36 through the outer tube 26. The bottom openings 36 permit liquid to pass from the annulus into the crescent shaped conduit.

The cross-sectional area of the inner tube 30 is slightly larger than the cross-sectional crescent shaped area between the inner and outer tubes considering the separated gas flow rate. In addition, a sufficiently large cross-sectional annulus area between the separator apparatus and well casing is important.

Figure 4:
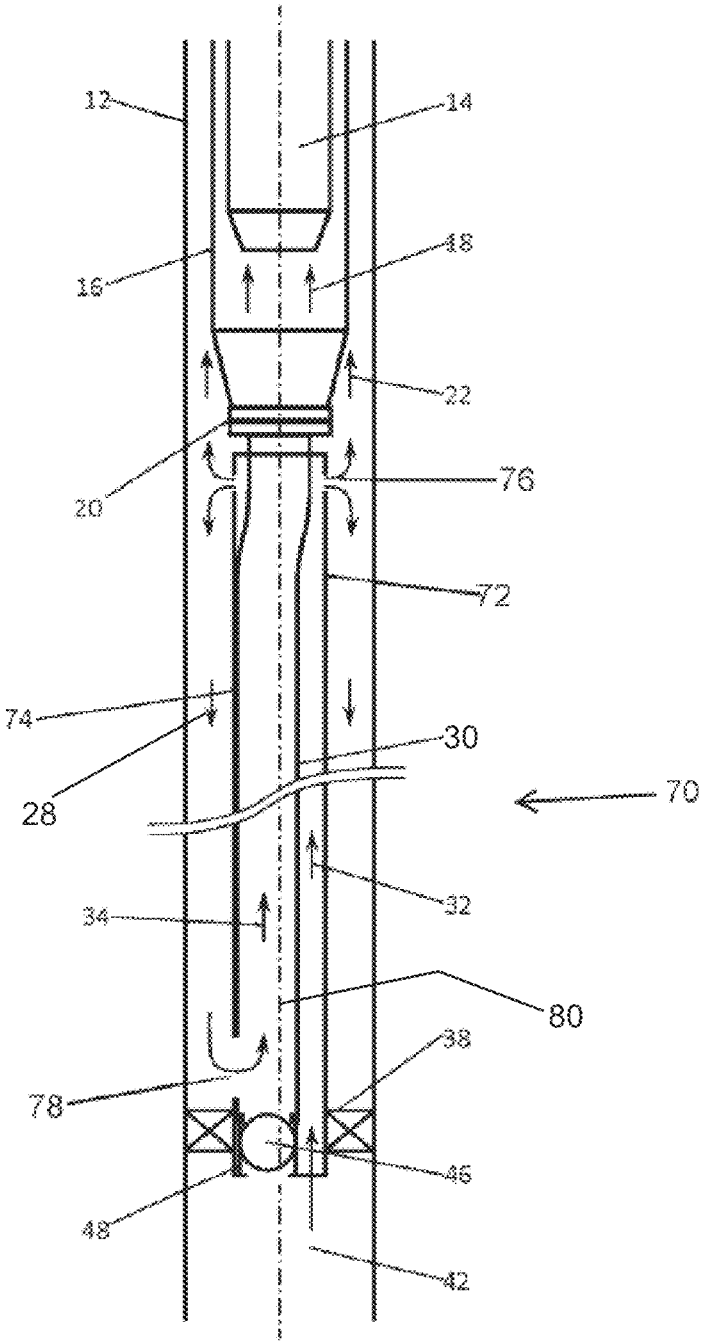

FIG. 4 illustrates a simplified diagrammatic view of another preferred embodiment of an apparatus 70 and method for downhole gas separation in accordance with the present invention for wells with sand or other solids production. A cylindrical well casing 12 extends downhole from the surface (not shown) and terminates in an open end. The separator apparatus 70 is installed vertically or installed with an inclination angle (not shown). A gas-liquid mixture from a reservoir flows to the bottom hole 42 of a subterranean well. Dashed line 80 illustrates the center line or axis of the well.

The separator apparatus 70 is suspended from equipment installed downhole. In the present embodiment, the apparatus is suspended from a shroud 16 of an ESP motor 14 through a connection 20. It will be appreciated that the separator apparatus 70 may be suspended from other equipment within the spirit and scope of the invention.

The gas separator apparatus 70 includes an outer tube 72 having an inner diameter. The outer tube 72 is generally concentric with the center line axis 80 of the well. An inner tube 74 having an outer diameter smaller than an inner diameter of the outer tube 72 is within the outer tube 72 and eccentric therefrom. The inner tube 74 is set against or aligned against an inner wall of the outer tube 72.

The gas-liquid mixture flows from the bottom hole 42 into a crescent shaped area formed by the separator outer tube 72 and the separator inner tube 74, and moves upward and exits at an outlet or outlets 76 passing through the outer tube 72. In the annulus formed by the well casing 12 and the gas separator outer tube 72, gas and liquid separate by gravity. Gas flows upward by floatation as shown by arrows 22 and liquid flows downward by gravity as shown by arrows 28.

The cross sectional area of the annulus between the well casing 12 and separator outer tube 72 is established sufficiently large so that the liquid downward flow velocity will be low and only very small gas bubbles can be entrained by the liquid. At the bottom of the separator apparatus 70, the annulus is plugged by a packer 38. The packer 38 creates a fluid tight seal and centers the apparatus 10.

Liquid flows from the annulus into the inner tube 74 of the gas separator apparatus through an opening or openings 78 through the outer tube 72 and the inner tube 74 near the bottom.

A ball valve has a ball 46 within a cage 48 located between the inner tube 74 and the well. The ball 46 is moveable vertically a small distance within the cage 48. During operation of the pump during oil production, the ball 46 is drawn upward in the cage 48 by force of the pump and motor. The bottom of the inner tube 74 is blocked by the ball 46 during normal operation of the pump so that fluid in the bottom hole 42 is prevented from passing into the inner tube.

Figure 5:
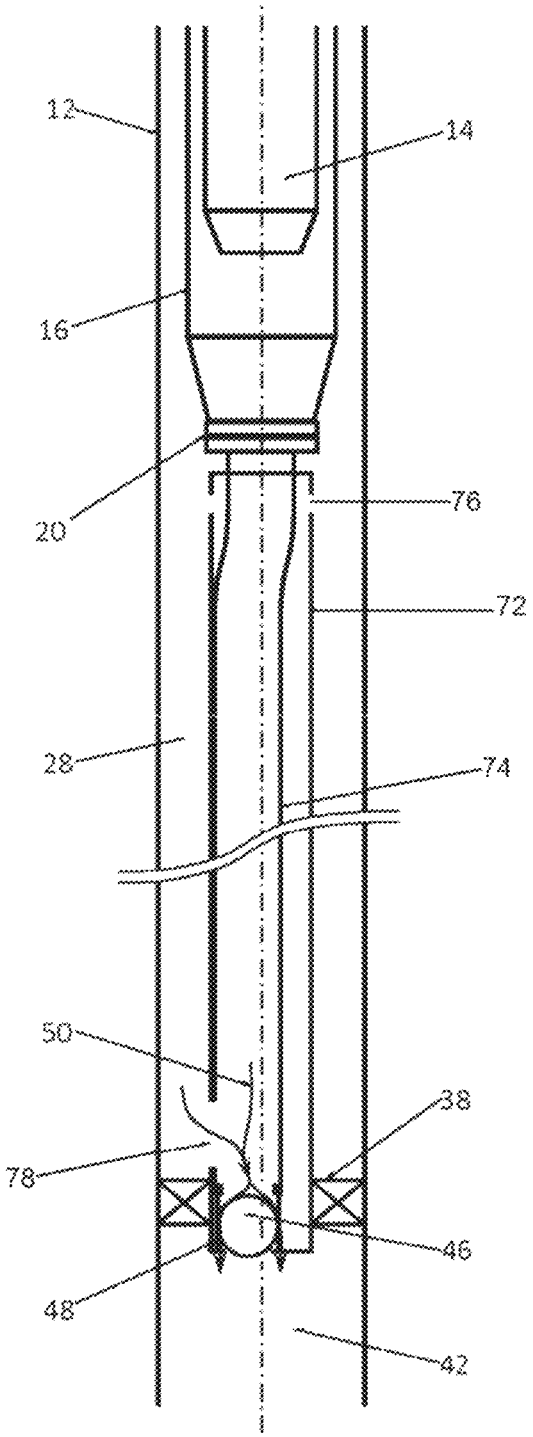
FIG. 5 illustrates the eccentric pipe-in-pipe gas separator apparatus shown in FIG. 4 with sand particles settling through the opening of the bottom ball valve during shut-in condition.

Liquid flows upward inside the inner tube 74 and continues into a shroud 16 or inlet of an ESP or other type of pump through the tubing 74. During shut-in condition when the pump and/or motor is off, the ball 46 will fall by gravity to the bottom of the cage 48 and leave an opening between the ball 46 and its cage seat. Sand or solid particles 50 can sink through the opening into the bottom hole, as shown in FIG. 5.

Figure 6:
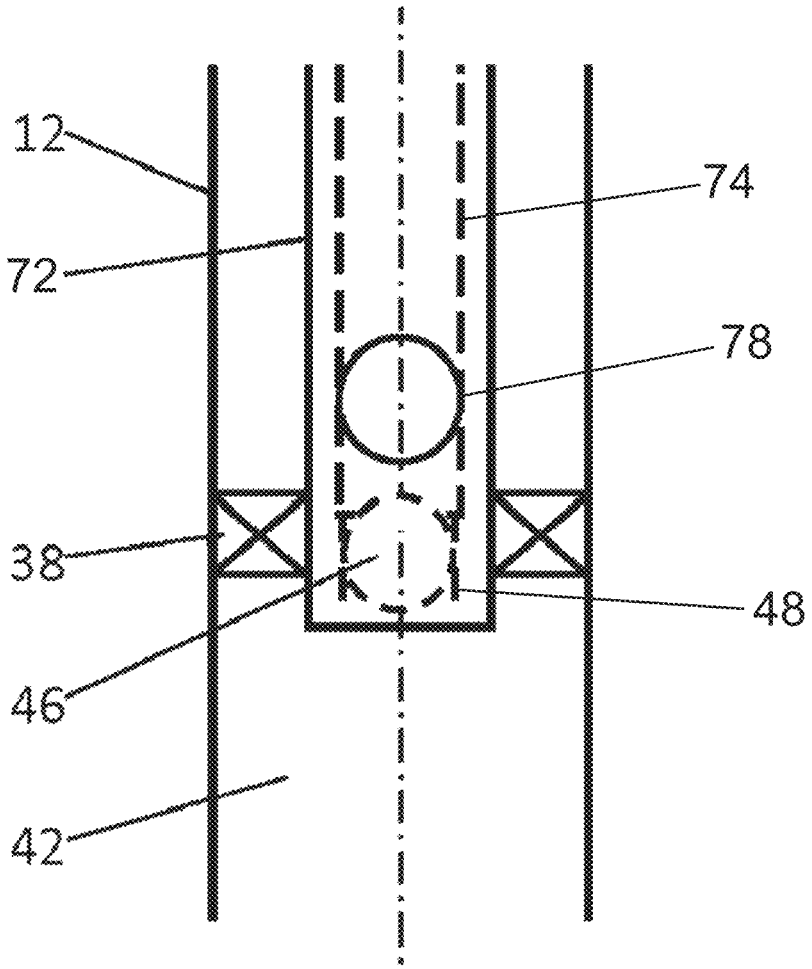
FIG. 6 illustrates a partial sectional, side view of the eccentric pipe-in-pipe gas separator apparatus with the bottom ball valve shown in FIG. 4.

FIG. 6 illustrates a partial sectional side view of the gas separator apparatus 70 with implementation of the bottom ball valve feature. The apparatus 70 is rotated 90° from views in FIGS. 4 and 5. The opening 78 through the outer tube 72 and inner tube is visible. The ball 46, the cage 48 and the inner tube 74 are shown in dashed lines.

The cross-sectional area of the inner tube 74 is slightly larger than the cross-sectional crescent shaped area between the inner and outer tubes. The embodiment of the gas separator apparatus 70 shown in FIGS. 4 through 6 avoids sand or solids accumulation during shut-in condition.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Whereas, the present invention has been described in relation to the drawings attached hereto, it should be understood that other and further modifications, apart from those shown or suggested herein, may be made within the spirit and scope of this invention.

What is claimed is:

1. An eccentric pipe-in-pipe downhole gas separator apparatus suspended from equipment installed downhole in a casing in a downhole well, for separation of gas from liquid in said downhole well, the apparatus comprising:

an outer tube having a length and having an inner diameter;

a packer between said casing and said outer tube creating a fluid tight seal;

an inner tube having a length and having an outer diameter smaller than said inner diameter of said outer tube, said inner tube within and eccentric from said outer tube throughout the lengths of said inner tube and said outer tube, wherein said inner tube is set against an inner wall of said outer tube and wherein an axis of said inner tube is parallel to an axis of said outer tube, and wherein a conduit having a crescent shaped cross-section is formed between said inner diameter of said outer tube and said outer diameter of said inner tube.

2. The eccentric pipe-in-pipe downhole gas separator apparatus as set forth in claim 1 wherein a bottom of said inner tube is open to the downhole well and a top of the said inner tube passes through a wall of said outer tube.

3. The eccentric pipe-in-pipe downhole gas separator apparatus as set forth in claim 2 wherein a plurality of openings are provided through said wall of said outer tube near a bottom.

4. The eccentric pipe-in-pipe downhole gas separator apparatus as set forth in claim 1 wherein a bottom of said conduit having a crescent shaped cross-section is sealed from said well.

5. The eccentric pipe-in-pipe downhole gas separator apparatus as set forth in claim 1 wherein a cross-sectional area of said inner tube is larger than an area of said conduit having a crescent shaped cross-section.

6. The eccentric pipe-in-pipe downhole gas separator apparatus as set forth in claim 1 wherein a top of the said outer tube is adapted for connection to an inlet of a pump.

7. The eccentric pipe-in-pipe downhole gas separator set forth in claim 6 wherein said top of said outer tube is connected to a motor shroud.

8. The eccentric pipe-in-pipe downhole gas separator apparatus as set forth in claim 1 wherein a bottom of said inner tube is open to said well.

9. The eccentric pipe-in-pipe downhole gas separator apparatus as set forth in claim 1 wherein said inner tube has a top and an opposed bottom and wherein said bottom of said inner tube is connected to a ball valve having a ball in a cage and wherein said cage permits vertical movement of said ball.

10. The eccentric pipe-in-pipe downhole gas separator apparatus as set forth in claim 9 wherein an opening is provided near said bottom of said outer tube to connect an inside of said inner tube and the outside of the said outer tube.

11. The eccentric pipe-in-pipe downhole gas separator apparatus as set forth in claim 9 wherein, during shut-in condition, the ball in the ball valve cage falls to a lower position, creating an opening at the bottom of the said inner tube for sand particles to sink through said opening.

12. The eccentric pipe-in-pipe downhole gas separator apparatus as set forth in claim 9 wherein a top of said inner tube is connected to an inlet of a pump.

13. The eccentric pipe-in-pipe downhole gas separator apparatus as set forth in claim 9 wherein a bottom of said crescent-shaped conduit is open to said well.

* * * * *